US009303847B2

(12) United States Patent
Dellian et al.

(10) Patent No.: US 9,303,847 B2
(45) Date of Patent: Apr. 5, 2016

(54) PROCESS FOR PRODUCING AN LED LAMP AND A CORRESPONDING LED LAMP

(75) Inventors: Harald Dellian, Soyen (DE); Stefan Otzen, Munich (DE); Fabian Reingruber, Munich (DE); Thomas Schmacht, Erdweg (DE)

(73) Assignee: OSRAM GmbH, Munich (DE)

( * ) Notice: Subject to any disclaimer, the term of this patent is extended or adjusted under 35 U.S.C. 154(b) by 156 days.

(21) Appl. No.: 13/990,838

(22) PCT Filed: Nov. 22, 2011

(86) PCT No.: PCT/EP2011/070654
§ 371 (c)(1),
(2), (4) Date: May 31, 2013

(87) PCT Pub. No.: WO2012/072449
PCT Pub. Date: Jun. 7, 2012

(65) Prior Publication Data

US 2013/0258668 A1 Oct. 3, 2013

(30) Foreign Application Priority Data

Dec. 2, 2010 (DE) ..... 10 2010 062 331

(51) Int. Cl.
*F21S 4/00* (2006.01)
*H01R 13/62* (2006.01)
(Continued)

(52) U.S. Cl.
CPC ..... *F21V 17/08* (2013.01); *F21V 17/005* (2013.01); *F21V 19/004* (2013.01);
(Continued)

(58) Field of Classification Search
CPC . F21V 19/004; F21V 19/0045; F21V 17/005; F21V 17/04; F21V 17/08; F21V 19/005; F21V 29/00; F21V 15/011; F21V 19/0035; F21V 29/22; F21V 17/162; F21S 4/00; F21Y 2101/02; F21Y 213/003; F21Y 2103/022; G09F 15/0018; G09F 7/16; G09F 13/0413; G09F 2013/0445
USPC ..... 362/225; 439/327; 361/759; 40/607.14
See application file for complete search history.

(56) References Cited

U.S. PATENT DOCUMENTS 3,132,431 A * 5/1964 Petrie ..... 40/611.06
4,326,240 A * 4/1982 Shaffer et al. ..... 362/11
(Continued)

FOREIGN PATENT DOCUMENTS

CN 101463971 A 6/2009
CN 201437913 U 4/2010
(Continued)

OTHER PUBLICATIONS

English abstract of DE 10116957 A1 dated Oct. 10, 2002.
(Continued)

*Primary Examiner* — Evan Dzierzynski
*Assistant Examiner* — Erin Kryukova
(74) *Attorney, Agent, or Firm* — Viering, Jentschura & Partner MBB

(57) ABSTRACT

A method for producing an LED lamp includes a lamp housing wherein at least one carrier circuit board equipped with LEDs is inserted into the lamp housing in such a way that at least a subregion of the lamp housing protrudes beyond the carrier circuit board with a projection, and the projection is at least partially deformed after insertion in such a way that the lamp housing is pressed with the carrier circuit board.

9 Claims, 6 Drawing Sheets

(51) Int. Cl.

| | |
|---|---|
| ***H01K 5/00*** | (2006.01) |
| ***B29C 65/00*** | (2006.01) |
| ***F21V 17/08*** | (2006.01) |
| ***F21V 17/00*** | (2006.01) |
| ***F21V 19/00*** | (2006.01) |
| ***F21V 29/507*** | (2015.01) |
| ***F21V 29/70*** | (2015.01) |
| *F21Y 101/02* | (2006.01) |
| *F21Y 103/00* | (2006.01) |
| *F21Y 103/02* | (2006.01) |

(52) U.S. Cl.

CPC ..... *F21V 19/005* (2013.01); *F21V 19/0035* (2013.01); *F21V 29/507* (2015.01); *F21V 29/70* (2015.01); *F21S 4/003* (2013.01); *F21Y 2101/02* (2013.01); *F21Y 2103/003* (2013.01); *F21Y 2103/022* (2013.01); *Y10T 29/49124* (2015.01)

(56) References Cited

U.S. PATENT DOCUMENTS

| | | | | |
|---|---|---|---|---|
| 4,399,491 | A * | 8/1983 | Kackenmeister | 362/11 |
| 8,899,788 | B2 * | 12/2014 | Lin et al. | 362/249.02 |
| 2005/0168985 | A1 * | 8/2005 | Chen | 362/241 |
| 2007/0109751 | A1 * | 5/2007 | Mayer et al. | 361/719 |
| 2008/0106892 | A1 * | 5/2008 | Griffiths et al. | 362/223 |
| 2008/0211893 | A1 * | 9/2008 | Oyanagi et al. | 347/102 |
| 2009/0021949 | A1 * | 1/2009 | Beck et al. | 362/362 |
| 2009/0154170 | A1 | 6/2009 | Fang et al. | |
| 2009/0185379 | A1 * | 7/2009 | Chen | 362/294 |
| 2009/0296381 | A1 * | 12/2009 | Dubord | 362/218 |
| 2010/0302777 | A1 | 12/2010 | Knoll et al. | |
| 2010/0328947 | A1 * | 12/2010 | Chang et al. | 362/249.02 |
| 2011/0038147 | A1 * | 2/2011 | Lin et al. | 362/235 |
| 2011/0095690 | A1 * | 4/2011 | Sagal | 315/113 |
| 2011/0248631 | A1 * | 10/2011 | Chuang | 315/32 |
| 2012/0120659 | A1 * | 5/2012 | Lopez et al. | 362/249.02 |
| 2013/0058091 | A1 * | 3/2013 | Hast et al. | 362/249.04 |
| 2013/0294062 | A1 * | 11/2013 | Li | 362/225 |

FOREIGN PATENT DOCUMENTS

| | | | |
|---|---|---|---|
| CN | 101858514 | A | 10/2010 |
| DE | 10116957 | A1 | 10/2002 |
| DE | 102007050893 | A1 | 4/2009 |
| DE | 202010008114 | U1 | 10/2010 |
| EP | 1247690 | A2 | 10/2002 |
| EP | 2072891 | A1 | 6/2009 |

OTHER PUBLICATIONS

Chinese Office Action based on Application No. 2011800570315 (7 pages with 6 pages English translation) dated Feb. 25, 2015.

* cited by examiner

PROCESS FOR PRODUCING AN LED LAMP AND A CORRESPONDING LED LAMP

RELATED APPLICATIONS

The present application is a national stage entry according to 35 U.S.C. §371 of PCT application No.: PCT/EP2011/070654 filed on Nov. 22, 2011, which claims priority from German application No.: 10 2010 062 331.8 filed on Dec. 2, 2010.

TECHNICAL FIELD

Various embodiments relate to LED lamps which have at least one lamp housing and a carrier circuit board equipped with LEDs.

BACKGROUND

Carrier circuit boards sometimes equipped with LEDs are screwed to lamp housings in LED retrofit lamps or LED luminaires. This fitting in principle guarantees effective heat transfer from the LED via the carrier circuit board to the housing or heat sink. Even in the case of LED tubes which act as a replacement for the conventional fluorescent tubes, the carrier circuit board equipped with LEDs is often screwed to a lamp housing.

One disadvantage with screw connections consists in that a lamp housing consisting of plastics can break when the screws are tightened excessively. In addition, owing to the drilled holes required for the screw connection, there is the problem of lines running within the heat sink. These lines result in a hazardous mains potential. The insulation of these lines which is intended to protect the user from an electric shock on contact with the heat sink may be damaged by the metal chips resulting during drilling or by the ends of screws.

In addition, the screwing process is very cost-intensive. Also, alternatively, possible adhesive bonds result in a relatively high degree of complexity involved for the application of the adhesive and a time pressure under which the parts need to be joined in order that the adhesive does not dry.

SUMMARY

Various embodiments provide a method for producing an LED lamp by means of which an improved and screw-free connection is provided between a lamp housing and a carrier circuit board equipped with LEDs.

In the method for producing an LED lamp including a lamp housing according to various embodiments, a carrier circuit board is inserted into the lamp housing in such a way that at least a subregion of the lamp housing protrudes beyond the carrier circuit board with a projection. After the insertion, the projection is at least partially deformed in such a way that the lamp housing is pressed with the carrier circuit board.

This method sequence results in the advantage that additional working steps, such as drilling of the carrier circuit board and the lamp housing, for example, can be avoided and the carrier circuit board can only be inserted into the already prefabricated lamp housing. Owing to the reshaping of the projection, in particular the chips and screw operations which are critical for the electrical conductors are avoided. By varying the deforming process, different regions of the projection or of the individual projections can be deformed. Accordingly, the deformation region can be selected markedly more flexibly than in the case of a screw connection, for example, since no additional drilled holes need to be provided in the housing. As a result of the production method according to various embodiments, therefore, a method is provided which can be used flexibly and is at the same time simple and inexpensive and which enables an optimum force-fitting connection between the components.

In a particularly preferred development of the production method according to various embodiments, only a subregion of the deformed projection is deformed in such a way that the deformed region has a notch. If, for example, a carrier circuit board is inserted into an elongate lamp housing (for example lamp tube), the projection cannot be deformed over the entire length, but instead only in a subregion. According to various embodiments, part of the projection can be pushed into the center of the lamp housing, as a result of which a notch is produced. This results in the advantage that, in this way, form-fitting and force-fitting connection regions can be provided in a particularly simple manner.

In a further preferred embodiment, the carrier circuit board is inserted or pushed into the lamp housing in a form-fitting manner. The lamp housing has a correspondingly shaped carrier circuit board bed for accommodating the carrier circuit board. Owing to the corresponding dimensions given to the lamp housing and the carrier circuit board bed, it is possible to insert or push in the carrier circuit board in a form-fitting manner. The positioning of the carrier circuit board which is achieved in this way with respect to the housing enables a favorable and advantageous method procedure of the production method according to various embodiments.

In a further particularly preferred embodiment, at least one insulating layer is inserted between the lamp housing and the carrier circuit board. As a result, preferred insulation is achieved between the lamp housing and the carrier circuit board and therefore the shield in a particularly simple manner. A variable factor here consists in whether the insulating layer surrounds all of the regions between the carrier circuit board and the lamp housing/lamp base or only subregions. In addition, a variation can be provided in terms of either the thickness of the insulating layer or whether one or more layers are used.

In a further advantageous configuration of various embodiments, a plastic cover is arranged on the carrier circuit board on that side of the carrier circuit board which is remote from the lamp housing, i.e. on that side on which the LEDs are preferably arranged. The plastic cover is preferably laid onto the carrier circuit board, wherein the regions in which the LEDs are arranged on the carrier circuit board can be left free. As a result, the protection of the carrier circuit board is ensured in a particularly simple manner.

Preferably, during the reshaping of the projection, a die is laid onto the carrier circuit board or the cover located thereabove at least in a subregion, wherein the die interacts with the forming tool. The die interacts with a forming tool in such a way that the projections can be deformed in subregions or overall in such a way that the carrier circuit board is pressed with the lamp housing or the lamp base corresponding to the method according to various embodiments. As a result, the die can preferably have cutouts, which mean that the regions of the projections to be deformed can be pressed into the cutouts by means of the forming tool and, as a result, notches can also be produced. This results in the advantage that defined regions of the projection can easily be deformed in a targeted manner.

A further advantage consists in that the lamp housing and the carrier circuit board have at least one corresponding position securing means. This is a particularly simple way of ensuring that the corresponding components have a fixed position in relation to one another.

In a further preferred embodiment, the carrier circuit board consists of FR4, ceramic or a metal-core circuit board. In a further preferred embodiment, the lamp housing is in the form of a heat sink. This results in the advantageous effect that a temperature compensation between the lamp housing and the ambient temperature or alternative cooling media can thus be achieved in a particularly simple manner.

In a preferred development, the projection has a fold at its free end. This provides a simple way of ensuring that the carrier circuit board can be inserted or clipped into the lamp housing or the lamp base. Therefore, insertion can also be understood to mean clipping-in in this context. The formation of a fold at a free end of the projection is a simple way of ensuring that the carrier circuit board cannot fall out of the lamp housing or the lamp base before it is ultimately fixed by being pressed.

A further aspect of various embodiments relates to an LED lamp including a lamp housing and a carrier circuit board, characterized in that the carrier circuit board and the lamp housing are pressed with one another, in particular as claimed in one of claims 1 to 12.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawings that show, by way of illustration, specific details and embodiments in which the disclosed embodiments may be practiced.

Figure 1:
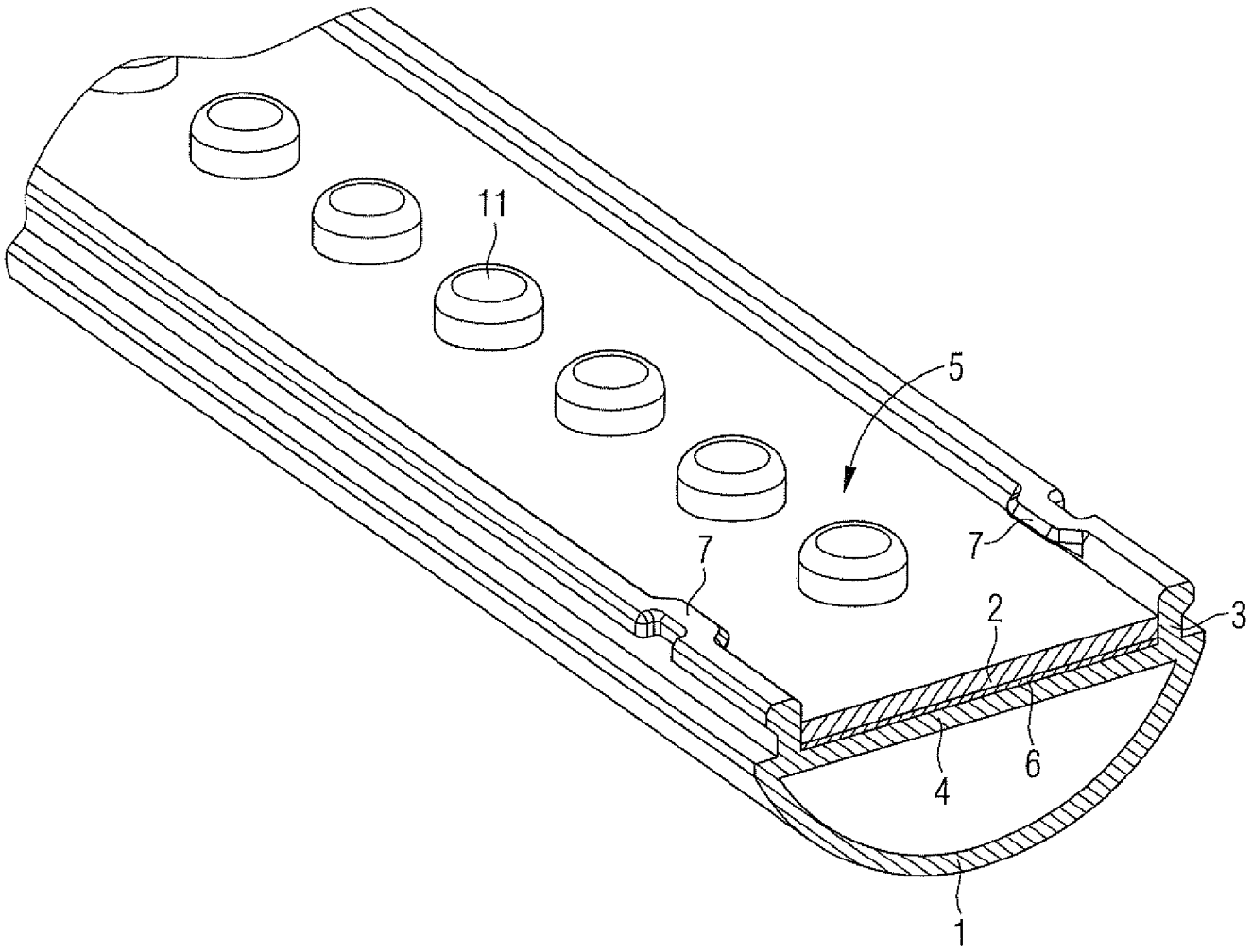
FIG. 1 shows a first exemplary embodiment of a production method according to the disclosed embodiment or an LED lamp produced according to the disclosed embodiment.

FIG. 1 shows a first exemplary embodiment of a production method according to the invention or an LED lamp produced according to the invention in a perspective illustration (retrofit tube). The LED lamp illustrated in FIG. 1 has an approximately semicylindrical lamp housing 1 with a central web 4. All other shapes of a lamp housing 1 and the carrier circuit board 2 are conceivable since they are usually matched to a specific intended use. Projections 3 are formed in each case on the left and the right on the lamp housing 1. A carrier circuit board 2 is arranged in the lamp housing 1 between the projections 3, wherein an insulating layer 6 is introduced between the carrier circuit board 2 and the lamp housing 1 or the central web 4. The projections 3 and the central web 4 in this case form the so-called carrier circuit board bed 5, in which the carrier circuit board 2 is arranged. In this case, the carrier circuit board bed 5 can have any desired configuration. In FIG. 1, the central web 4 is closed. As an alternative to this, the carrier circuit board bed 5 can be formed together with the projections 3 as shoulders, for example.

According to the invention, the lamp housing 1 is provided in a first method step. Then, either the carrier circuit board 2 on its own or together with at least one insulating layer 6 is inserted into the lamp housing 1, i.e. between the projections 3.

In a further method step, a die can be arranged on the carrier circuit board 2. In any case, in a further method step at least that part of the projection 3 which protrudes beyond the carrier circuit board is mechanically deformed. As a result, the notches 7 illustrated in FIG. 1 can be produced. Advantageously, the carrier circuit board 1 is arranged in the lamp housing 1, i.e. between the two projections 3, in a form-fitting manner in such a way that it bears against the projections 3 in a form-fitting manner. It is advantageous if both the lamp housing 1 and the carrier circuit board 2 have mutually corresponding positioning devices (not illustrated), for example by virtue of so-called lugs, with the result that the carrier circuit board 2 is positioned and fixed in relation to the lamp housing 1. In alternative embodiments of a projection 3, said projection can also be deformed entirely or predominantly.

In FIG. 1, LEDs are arranged on the carrier circuit board 2. The number, shape, function and arrangements of the LEDs is freely selectable. It is also possible to only equip the carrier circuit board 2 with the LEDs 11 retrospectively. It goes without saying that the LEDs 11 can be actuated and supplied with current correspondingly. Correspondingly known control and power supply devices can be arranged in the lamp housing 1, for example.

FIG. 1 shows two notches 7. The number and arrangements of the notches 7 are freely selectable. In addition, it is a matter of discretion as to the region in which the notches are arranged. It may be expedient for also the entire projection to be reshaped, with the result that the carrier circuit board 2 is pressed with the lamp housing 1 over the entire region.

In this case, the carrier circuit board 1 may include any desired substrates. In particular FR4, ceramic or else a metal-core circuit board are conceivable. Whether an insulating layer 6 is arranged between the carrier circuit board 2 and the lamp housing 1 and, if an insulating layer 6 is arranged, the thickness of this insulating layer and of the number of insulating layers, is a completely discretionary matter. It is conceivable for no insulating layer 6 to be arranged in some embodiments and for a plurality of layers to be arranged in other embodiments.

The greater the extent of and the quicker the notching process, i.e. the process of mechanically deforming the projection, the more tightly the two parts are pressed. Any minimum clearances after the pressing procedure are compensated for by the insulating layer 6, when such an insulating layer 6 is used. The production method according to the invention can also be used for conventional retrofits, i.e. replacement of incandescent lamps or radiators.

Figure 2:
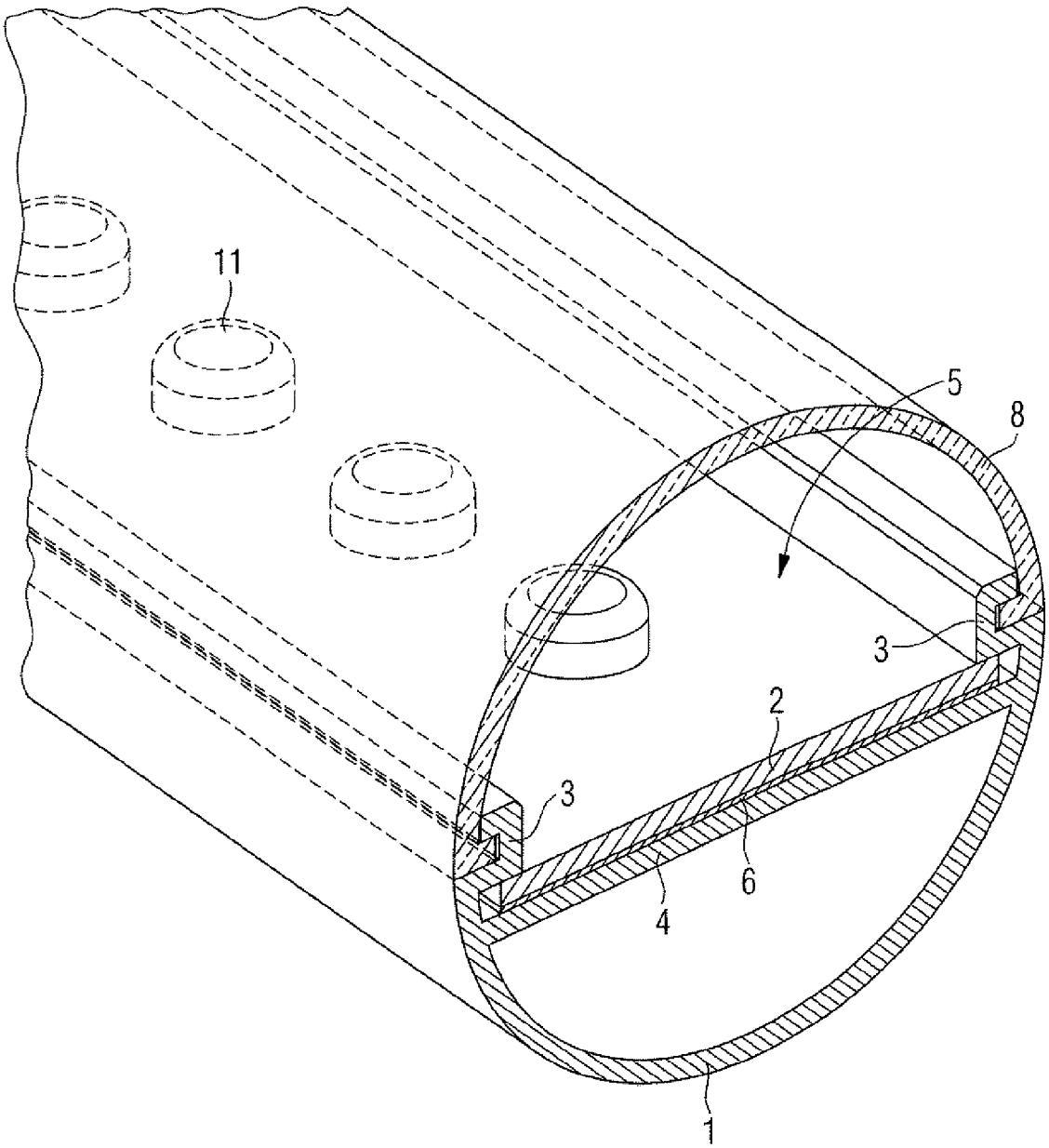
FIG. 2 shows a second exemplary embodiment of an LED lamp produced according to the disclosed embodiment.

FIG. 2 shows an alternative embodiment to that shown in FIG. 1. FIG. 2 shows in particular that the projections 3 may be configured differently and, in this embodiment, engage around the peripheral region of the carrier circuit board 2. In order to form an LED tube, in this preferred embodiment a transparent semi-cylindrical housing cover 8 has been arranged on the lamp housing 1. The notch 7 according to the invention is not shown here, but can have a comparable formation to the notch 7 illustrated in FIG. 1.

Figure 3:
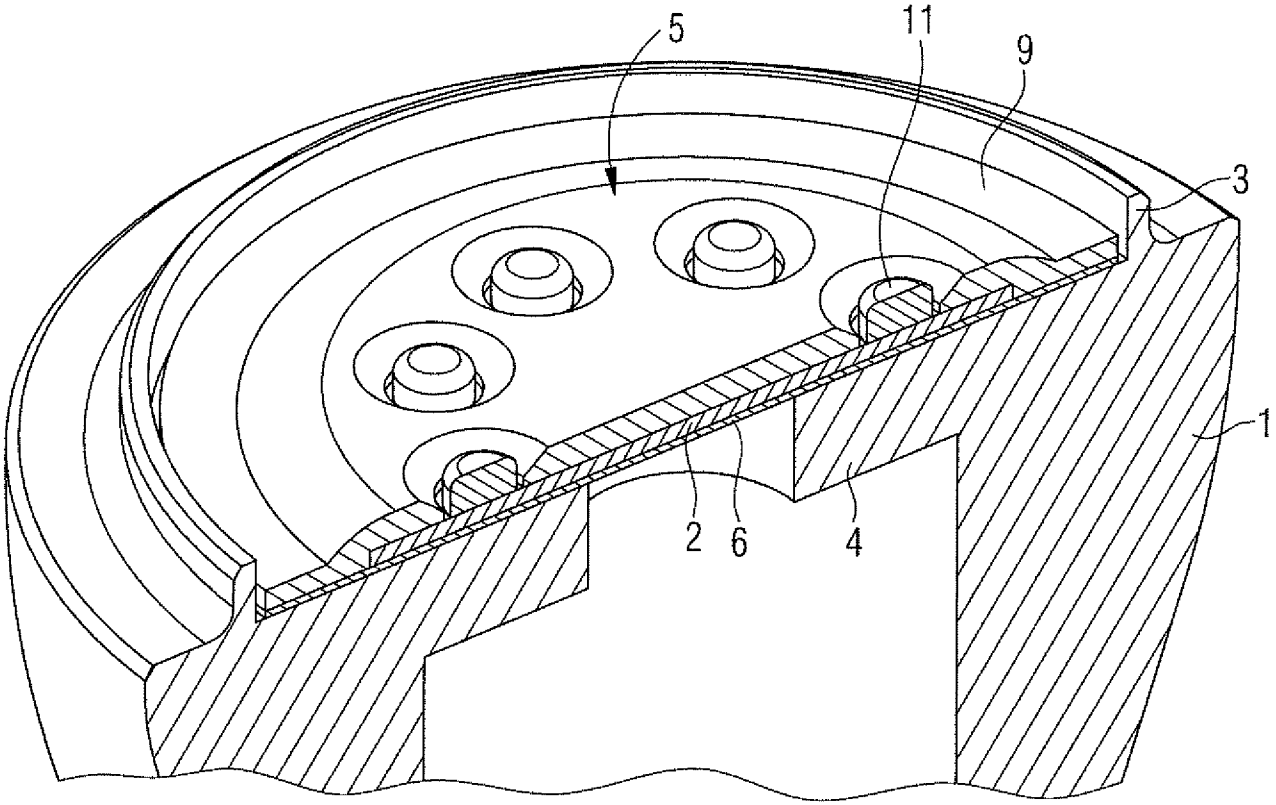
FIG. 3 shows a third exemplary embodiment of an LED lamp produced according to the disclosed embodiment in a perspective illustration.

FIG. 3 shows an approximately cylindrical lamp housing 1 in a perspective sectional illustration. The lamp housing 1 may, in all embodiments according to the invention, consist of different materials. Firstly plastics and secondly metals such as, for example, aluminum or a corresponding combination of other materials can be used. A circular projection 3 is formed on the cylindrical lamp housing 1. The circular projection encloses a circular carrier circuit board, i.e. said carrier circuit board is arranged in the lamp housing and has corresponding LEDs. The carrier circuit board 2 lies on a shoulder which, together with the projection 3, forms the carrier circuit board bed 5. A cover 9 which can protect the carrier circuit board from environmental influences such as moisture, for example, is arranged on the carrier circuit board 2. The cover 9 exposes the LEDs which have been arranged. The projection of the lamp housing may be reshaped by means of the method steps of the production method according to the invention at any desired number of points or else only at one point or else completely, with the result that the carrier circuit board is pressed with the lamp housing.

Figure 4:
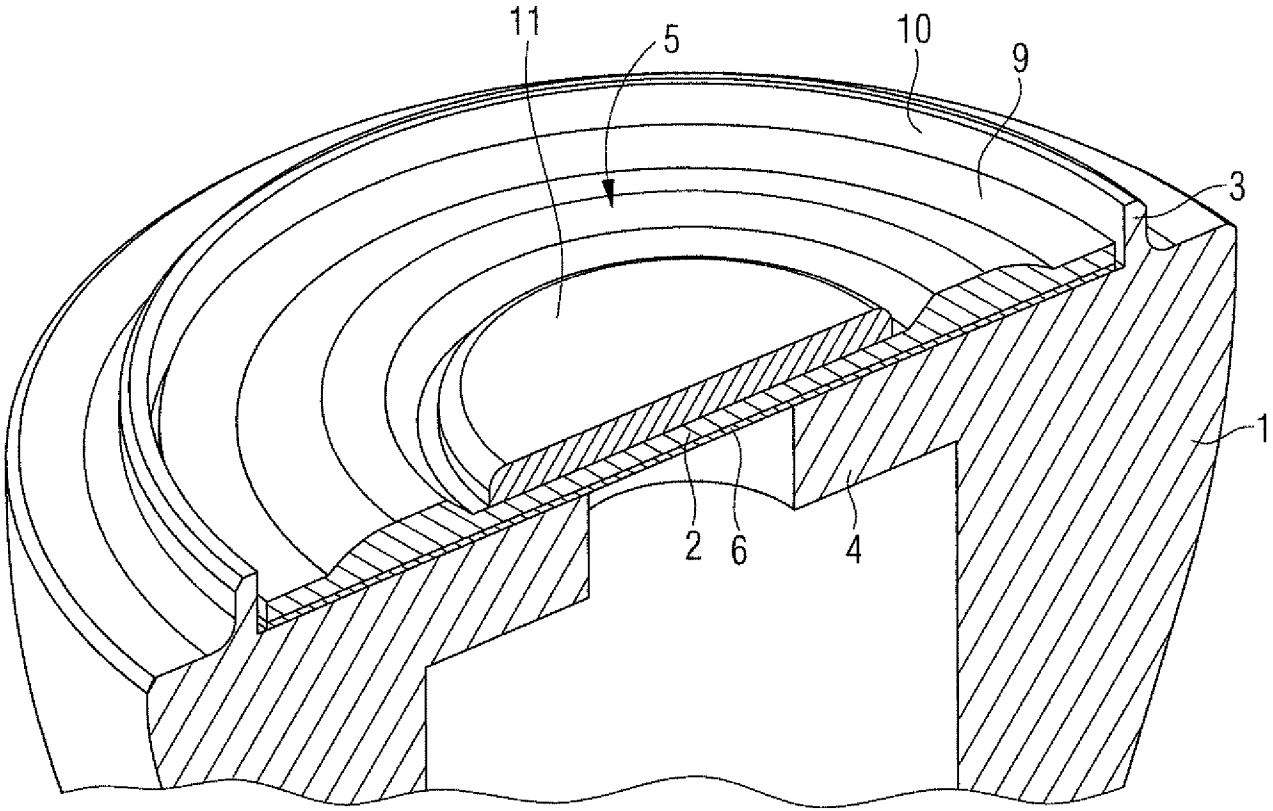
FIG. 4 shows a fourth exemplary embodiment of an LED lamp produced according to the disclosed embodiment in a perspective illustration.

FIG. 4 illustrates a cylindrical lamp housing which is comparable to the lamp housings shown in FIG. 3. A carrier circuit board 2 is arranged in the lamp housing 1 between the circular projection 3. The circular projection 3 has, at its free end, a fold 10, via which the carrier circuit board 2 or the cover 9 (likewise illustrated in FIG. 4) is clipped into the housing.

In this case, the cover 9 is arranged over the carrier circuit board 2 and the insulating layer 6. In accordance with the method according to the invention, the circular projection can be reshaped according to the invention at any desired number of points, with the result that, for example, notches are produced.

The LED lamp illustrated in FIG. 4 has a multichip LED. It goes without saying that LEDs with a wide variety of shapes, i.e. circular, elongate, etc. and a wide variety of technical specifications can be arranged in all of the embodiments. In addition, it is possible in all of the embodiments to protect the LED lamp and in particular the LEDs form environmental influences, such as, for example, moisture, by corresponding covers, which are partially transparent or completely transparent. In addition, it is possible to provide all of the LED lamps with a wide variety of configurations, i.e. in the form of the LED tubes illustrated, cylindrical LED lamps or else with a square, flexible-hose-like, triangular formation, etc.

Figure 5A:
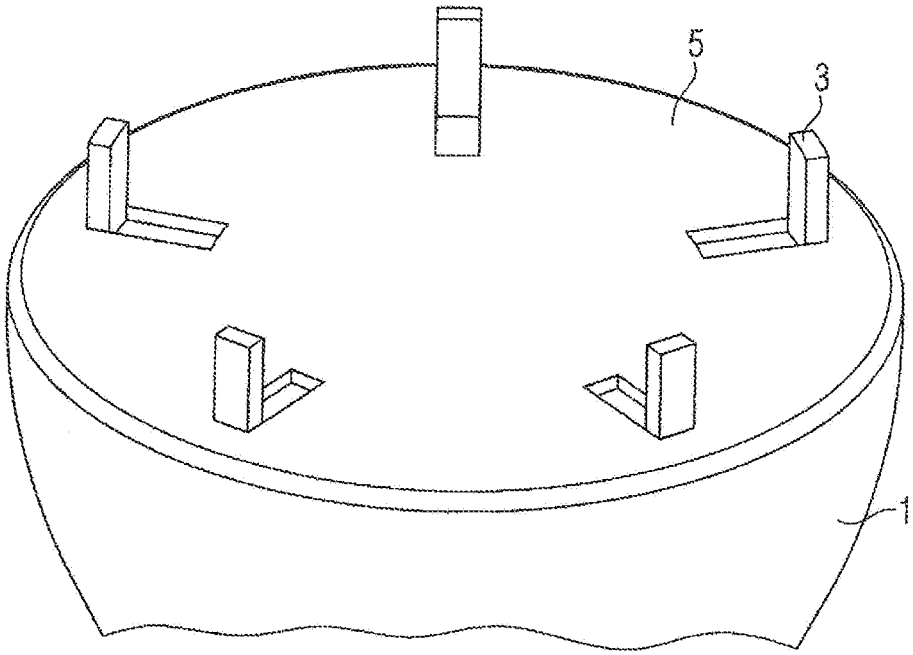
FIGS. 5A and 5B show a fifth exemplary embodiment of an LED lamp produced according to the disclosed embodiment in a perspective sectional illustration.
Figure 5B:
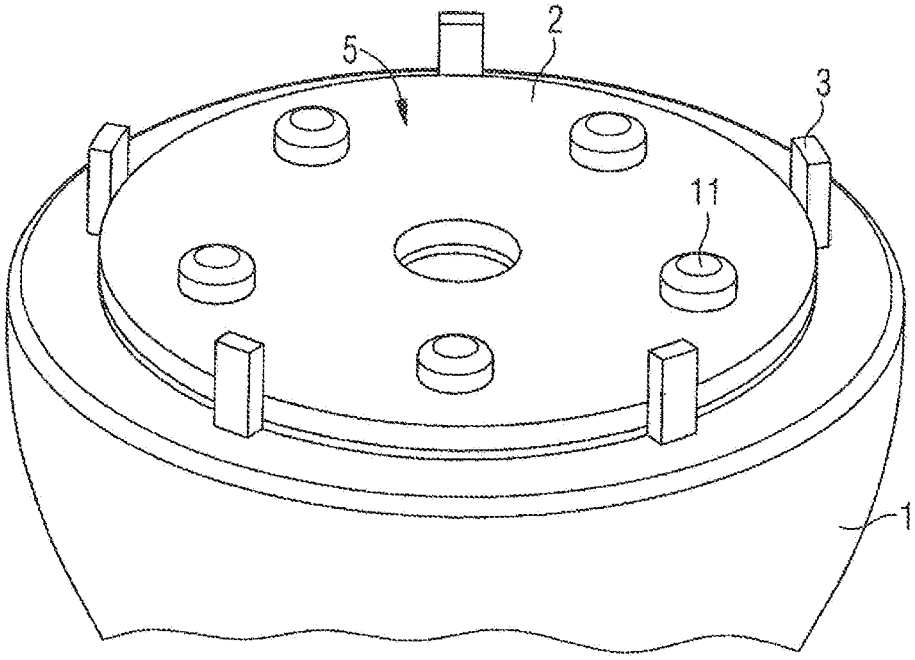

FIGS. 5A and 5B show an alternative embodiment of a lamp housing 1. The lamp housing 1 in this embodiment is formed from two parts. According to the invention, the lamp housing can also consist of a plurality of parts, wherein this can also include adapter pieces etc. In this case, the lamp housing itself may, in embodiments, be arranged in further housings or housing parts (for example by being screwed, adhesively bonded etc.). The lamp housing 1 has a plurality of projections 3, which have been stamped out, for example, in a preceding process step, which does not belong to the production method according to the invention. The correspondingly formed projections 3 shown in FIGS. 5A and 5B make it possible for them to be reshaped individually or together after insertion of the carrier circuit board in such a way that the carrier circuit board is pressed with the lamp housing.

Figure 6:
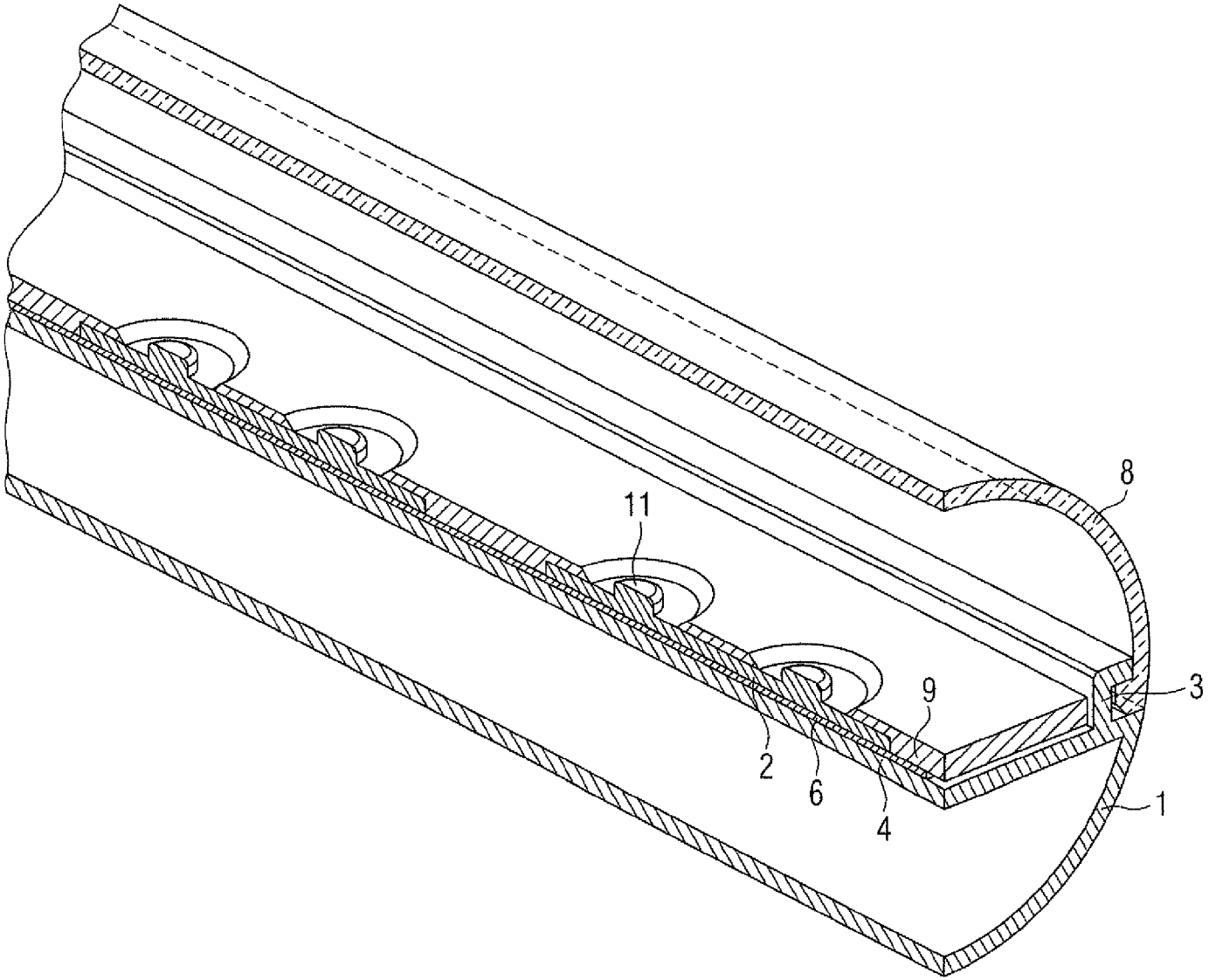
FIG. 6 shows a sixth exemplary embodiment of an LED lamp produced according to the disclosed embodiment in a perspective sectional illustration.

FIG. 6 shows a further embodiment of an LED tube in which a plurality of carrier circuit boards 2 are arranged in a carrier circuit board bed 5 and are held via a cover 9. All of the features described above and illustrated in the drawings can be used individually as desired or in any desired combination with one another, as a result of which in each case independent exemplary embodiments of the invention are realized. In the context of the invention, a corresponding method for fitting an LED lamp in which the individual components may be joined together in the manner shown in FIGS. 1 to 6 without the need for any screws is also included.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method for producing an LED lamp comprising:

inserting at least one carrier circuit board equipped with LEDs into a lamp housing sufficiently far that at least a subregion of the lamp housing protrudes beyond the carrier circuit board forming a projection, and at least partially deforming the projection after insertion in such a way that the lamp housing is pressed with the carrier circuit board, wherein, during the deformation of the projection, a die is laid onto the carrier circuit board and interacts with a forming tool.

2. The method of claim 1 wherein a deformed portion of the projection comprises a notch.

3. The method of claim 1 wherein the lamp housing is formed in one or more parts.

4. The method of claim 1, wherein the carrier circuit board is inserted or pushed into the lamp housing in a form fitting manner.

5. The method of claim 1, wherein a carrier circuit board bed is formed in the lamp housing.

6. The method of claim 1, wherein at least one insulating layer is inserted between the lamp housing and the carrier circuit board.

7. The method of claim 1, wherein a cover is laid on a side of the carrier circuit board which is remote from the lamp housing.

8. The method of claim 1, wherein the carrier circuit board is manufactured from FR4, ceramic or from a metal-core circuit board.

9. The method of claim 1, wherein the lamp housing is in the form of a heat sink.

* * * * *